US010355420B1

(12) United States Patent
Orris et al.

(10) Patent No.: US 10,355,420 B1
(45) Date of Patent: Jul. 16, 2019

(54) ELECTRICAL CONNECTOR WITH CONNECTED GROUND SHIELDS

(71) Applicant: TE CONNECTIVITY CORPORATION, Berwyn, PA (US)

(72) Inventors: David Patrick Orris, Middletown, PA (US); Chad William Morgan, Carneys Point, NJ (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/867,222

(22) Filed: Jan. 10, 2018

(51) Int. Cl.

| | |
|---|---|
| ***H01R 13/6585*** | (2011.01) |
| ***H01R 13/6587*** | (2011.01) |
| ***H01R 13/514*** | (2006.01) |
| ***H01R 12/71*** | (2011.01) |

(52) U.S. Cl.
CPC ..... *H01R 13/6587* (2013.01); *H01R 12/716* (2013.01); *H01R 13/514* (2013.01)

(58) Field of Classification Search
CPC ..... H01R 13/6585; H01R 13/6586; H01R 13/6587
USPC ..... 439/607.05–607.09, 607.14
See application file for complete search history.

(56) References Cited

U.S. PATENT DOCUMENTS

| | | | | |
|---|---|---|---|---|
| 6,506,076 | B2 * | 1/2003 | Cohen | H01R 23/688 439/607.09 |
| 7,988,491 | B2 | 8/2011 | Davis et al. | |
| 8,430,691 | B2 * | 4/2013 | Davis | H01R 13/6585 439/607.09 |
| 8,465,302 | B2 * | 6/2013 | Regnier | H01R 9/038 439/108 |
| 9,028,281 | B2 | 5/2015 | Kirk et al. | |
| 9,509,100 | B2 * | 11/2016 | Phillips | H01R 13/6587 |
| 2014/0194004 | A1 | 7/2014 | Pickel et al. | |

* cited by examiner

*Primary Examiner* — Hien D Vu

(57) ABSTRACT

An electrical connector includes a plurality of contact modules and ground shields. The ground shields are interleaved with the contact modules within a housing, such that the ground shields alternate with the contact modules. The contact modules include multiple electrical signal conductors held by a dielectric body of the respective contact module. Each of the ground shields includes a plate that defines a bridge slot therethrough and a ground bridge extending from the plate. The ground bridge extends from the plate at a location that is spaced apart from the bridge slot. The ground bridges of the ground shields extend laterally across corresponding contact modules. Distal tips of the ground bridges are received within the bridge slots of adjacent ground shields disposed along opposite sides of the corresponding contact modules, and the distal tips engage edges of the bridge slots to electrically connect the ground shields together.

20 Claims, 6 Drawing Sheets

ELECTRICAL CONNECTOR WITH CONNECTED GROUND SHIELDS

BACKGROUND OF THE INVENTION

The subject matter herein relates generally to electrical connectors with ground shields that are electrically connected.

Some electrical connectors include signal conductors held in discrete packages, referred to as contact modules or wafers, which are stacked within a connector housing. The electrical connectors may include ground shields that are disposed between the signal conductors of adjacent contact modules in order to provide electrical shielding between the contact modules. The electrical shielding may reduce crosstalk between the signal conductors of the adjacent contact modules, and thereby improve signal integrity and connector performance relative to connectors that lack intervening ground shields. The ground shields of the electrical connector may be spaced apart from each other along opposite sides of the contact modules. It may be desirable to electrically connect the ground shields together to electrically common the ground shields, such that the ground shields have the same electrical potential.

Known electrical connectors may include discrete ground tie bars or skewers that extend across the ground shields and the contact modules, with the ground tie bars mechanically engaging the ground shields to provide conductive paths between the ground shields. However, installing discrete ground tie bars may increase complexity and cost due to additional parts, tooling, and labor required to assemble the tie bars into the connectors. It also may be difficult to thread the ground tie bars across the stack into position engaging the ground shields due to difficulty ensuring that the ground shields and contact modules are properly aligned. Furthermore, the ground tie bars may not provide shielding, or at least adequate shielding, between multiple signal conductors that are within the same contact module, such as between an upper signal conductor and a lower signal conductor, to reduce crosstalk between signal conductors in the same contact module.

A need remains for an electrical connector with ground shields that can be efficiently and reliably electrically connected together to electrically common the ground shields, while providing sufficient electrical shielding for the signal conductors of the connector.

BRIEF DESCRIPTION OF THE INVENTION

With those needs in mind, one or more embodiments of the present disclosure provide an electrical connector that includes a plurality of contact modules and a plurality of ground shields. The contact modules are disposed side by side within a housing. Each of the contact modules includes multiple electrical signal conductors held by a dielectric body of the respective contact module. The ground shields are interleaved with the contact modules within the housing such that the ground shields alternate with the contact modules. Each of the ground shields includes a plate that defines a bridge slot therethrough and a ground bridge extending from the plate. The ground bridge extends from the plate at a location that is spaced apart from the bridge slot. The ground bridges of the ground shields extend laterally across corresponding contact modules. Distal tips of the ground bridges are received within the bridge slots of adjacent ground shields disposed along opposite sides of the corresponding contact modules, and the distal tips engage edges of the bridge slots to electrically connect the ground shields together.

In one or more embodiments of the present disclosure, an electrical connector is provided that includes a plurality of contact modules and a plurality of ground shields. The contact modules are disposed side by side within a housing. Each of the contact modules includes multiple electrical signal conductors held by a dielectric body of the respective contact module. The ground shields are interleaved with the contact modules within the housing such that the ground shields alternate with the contact modules. Each of the ground shields includes a plate and a ground bridge extending from the plate. The ground bridge includes a shoulder attached to the respective plate at a fixed end of the ground bridge, a shelf that extends to a distal tip of the ground bridge, and a jogged section between the shelf and the shoulder. The jogged section is angled or curved such that the shelf is disposed in a different plane than the shoulder. The ground bridges of the ground shields extend laterally across corresponding contact modules and the distal tips engage adjacent ground shields disposed along opposite sides of the corresponding contact modules to electrically connect the ground shields together.

In one or more embodiments of the present disclosure, an electrical connector is provided that includes a plurality of contact modules and a plurality of ground shields. The contact modules are disposed side by side within a housing. Each of the contact modules includes multiple electrical signal conductors held by a dielectric body of the respective contact module. The ground shields are interleaved with the contact modules within the housing such that the ground shields alternate with the contact modules. Each of the ground shields includes a plate that defines a bridge slot therethrough and a ground bridge extending from the plate. The ground shields are monolithic such that the ground bridges are unitary with the respective plates from which the ground bridges extend. The ground bridges of the ground shields extend laterally across corresponding contact modules. Distal tips of the ground bridges are received within the bridge slots of adjacent ground shields disposed along opposite sides of the corresponding contact modules, and the distal tips engage edges of the bridge slots to electrically connect the ground shields together.

DETAILED DESCRIPTION OF THE INVENTION

Embodiments of the present disclosure provide a novel and non-obvious way to establish a ground connection between ground shields within an electrical connector that avoids the disadvantages of threading discrete ground tie bars across a stack of ground shields and contact modules. For example, the embodiments of the electrical connector disclosed herein may establish direct electrical connections between the ground shields on opposite sides of contact modules that are more efficient, reliable, and/or less complex than known methods of installing ground tie bars. Electrically connecting the ground shields electrically commons the ground shields, which may improve the electrical signal performance of the electrical connector, such as by reducing return loss, relative to electrical connectors in which shielding elements are not electrically commoned together.

Figure 1:
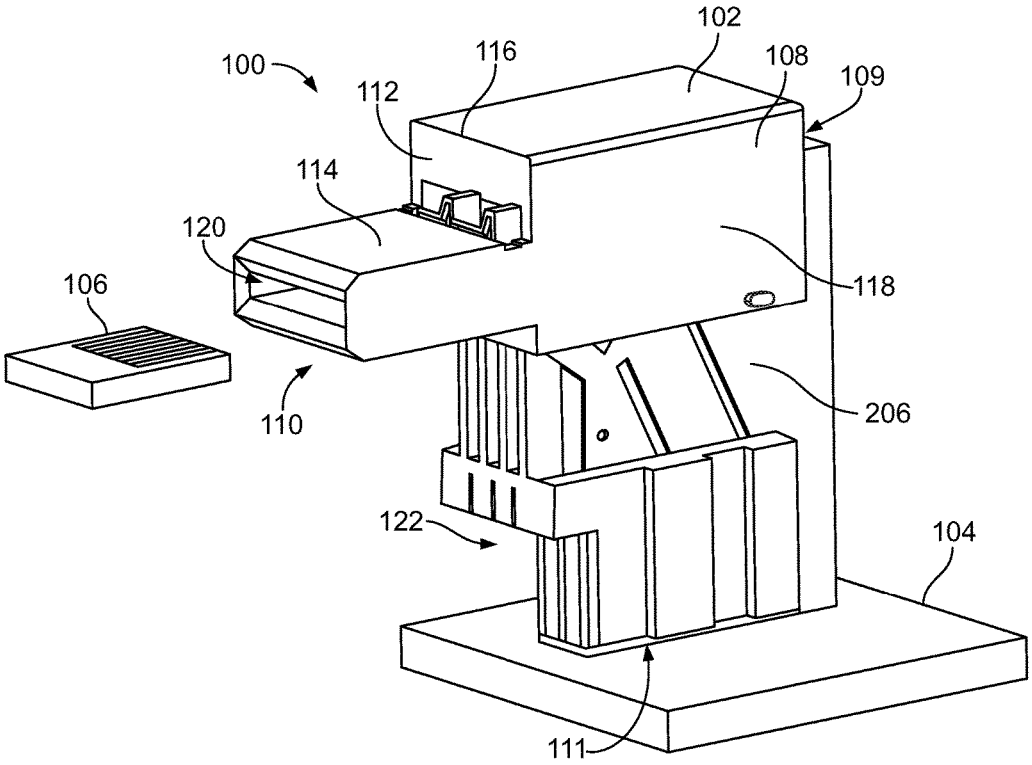
FIG. 1 is a perspective view of a connector system in accordance with an embodiment.

FIG. 1 is a perspective view of a connector system 100 in accordance with an embodiment. The connector system 100 includes an electrical connector 102 that is mounted on a circuit board 104. The connector system 100 further includes a circuit card 106 that is configured to mate with the electrical connector 102 to electrically connect the circuit card 106 and the electrical connector 102. Signals are transmitted between the circuit card 106 and the circuit board 104 through the electrical connector 102. The circuit card 106 may be a component of a mating connector (not shown), such as a cable-mounted plug connector. For example, the plug connector may be an input/output (I/O) transceiver configured to transmit information in the form of electrical signals and/or optical signals.

The electrical connector 102 has a mating end 110 and a mounting end 111. The mating end 110 includes at least one mating interface configured to engage the circuit card 106 when mated. The mounting end 111 engages and mounts to the circuit board 104. In the illustrated embodiment, the electrical connector 102 is a right angle connector such that a plane of the mating end 110 is oriented perpendicular to a plane of the mounting end 111. The electrical connector 102 may be an in-line connector in an alternative embodiment such that the mating end 110 and the mounting end 111 are at opposite ends of the connector 102, and are oriented along generally parallel planes.

The electrical connector 102 includes a housing 108 that holds a plurality of contact modules 204 (shown in FIG. 3) and ground shields 206 of the electrical connector 102. The housing 108 includes a front wall 112 and at least one mating shroud 114 that projects forward from the front wall 112. The mating shroud 114 defines a port or opening 120 that is configured to receive the mating circuit card 106 therein. The housing 108 only includes one mating shroud 114 in the illustrated embodiment, but may include two or more mating shrouds 114 along the front wall 112 in other embodiments. For example, the electrical connector 102 with multiple mating shrouds 114 may be simultaneously mated to circuit cards of multiple different mating connectors.

In an embodiment, the housing 108 includes other walls that extend from the front wall 112 to define a module cavity 109 within the housing 108. The contact modules 204 (shown in FIG. 3) and the ground shield 206 are held at least partially within the module cavity 109 of the housing 108. For example, the housing 108 may have a top wall 116, a first side wall 118, and a second side wall (not shown) opposite the first side wall 118, which each extend from the front wall 112. As used herein, relative or spatial terms such as "top," "bottom," "upper," "lower," "front," and "rear" are only used to distinguish the referenced elements and do not necessarily require particular positions or orientations in the surrounding environment of the connector system 100. The housing 108 may be at least partially open at the mounting end 111 of the connector 102 to allow the contact modules 204 and the ground shields 206 to protrude from the module cavity 109 for mounting and electrically connecting to the circuit board 104.

In the illustrated embodiment, the electrical connector 102 includes a nest cavity 122 along the front wall 112 that extends to the mounting end 111. In the illustrated embodiment, the electrical connector 102 is used as a single, standalone electrical connector.

Figure 2:
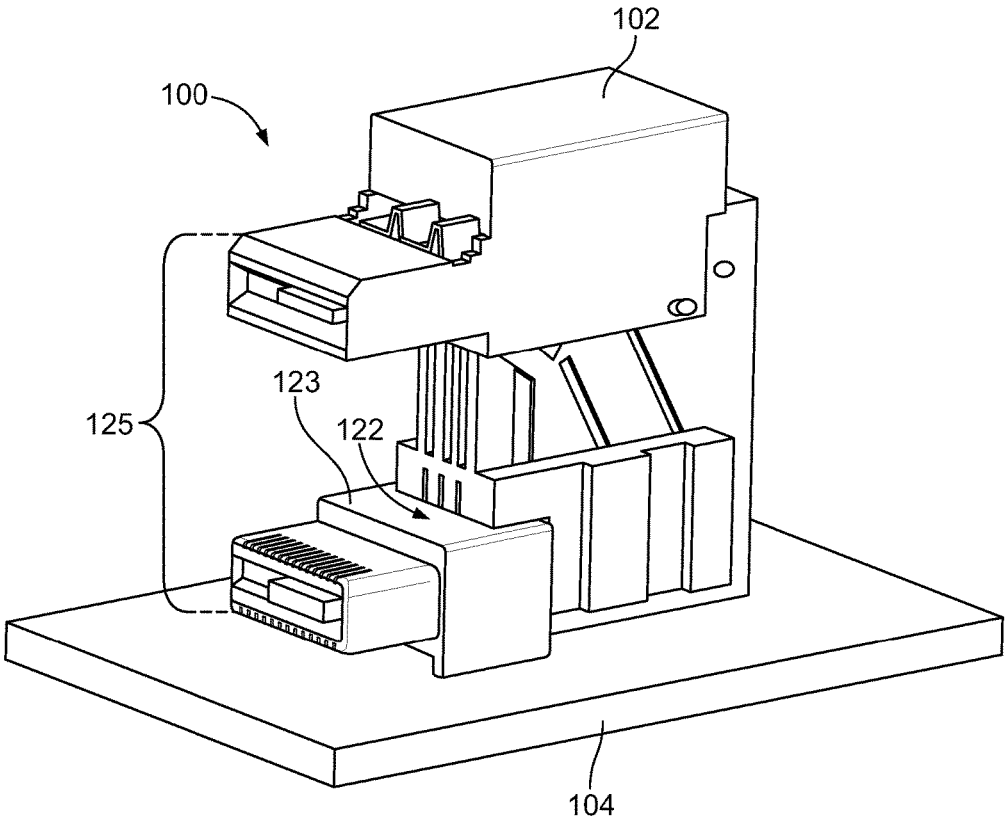
FIG. 2 is a perspective view of the connector system according to another embodiment in which an electrical connector of the connector system is disposed adjacent to another electrical connector to define a hybrid connector pair.

FIG. 2 is a perspective view of the connector system 100 according to another embodiment in which the electrical connector 102 is disposed adjacent to another electrical connector 123 to define a hybrid connector pair 125. For example, the electrical connector 123 has a shorter height from the circuit board 104 than the electrical connector 102. The shorter connector 123 is nested within the nest cavity 122 of the connector 102. The electrical connector 123 is separately mounted to the circuit board 104 relative to the connector 102. It is recognized that the electrical connector 102 described herein may be utilized as a single, standalone connector or as a member of a hybrid connector pair, like the pair 125 shown in FIG. 2.

Figure 3:
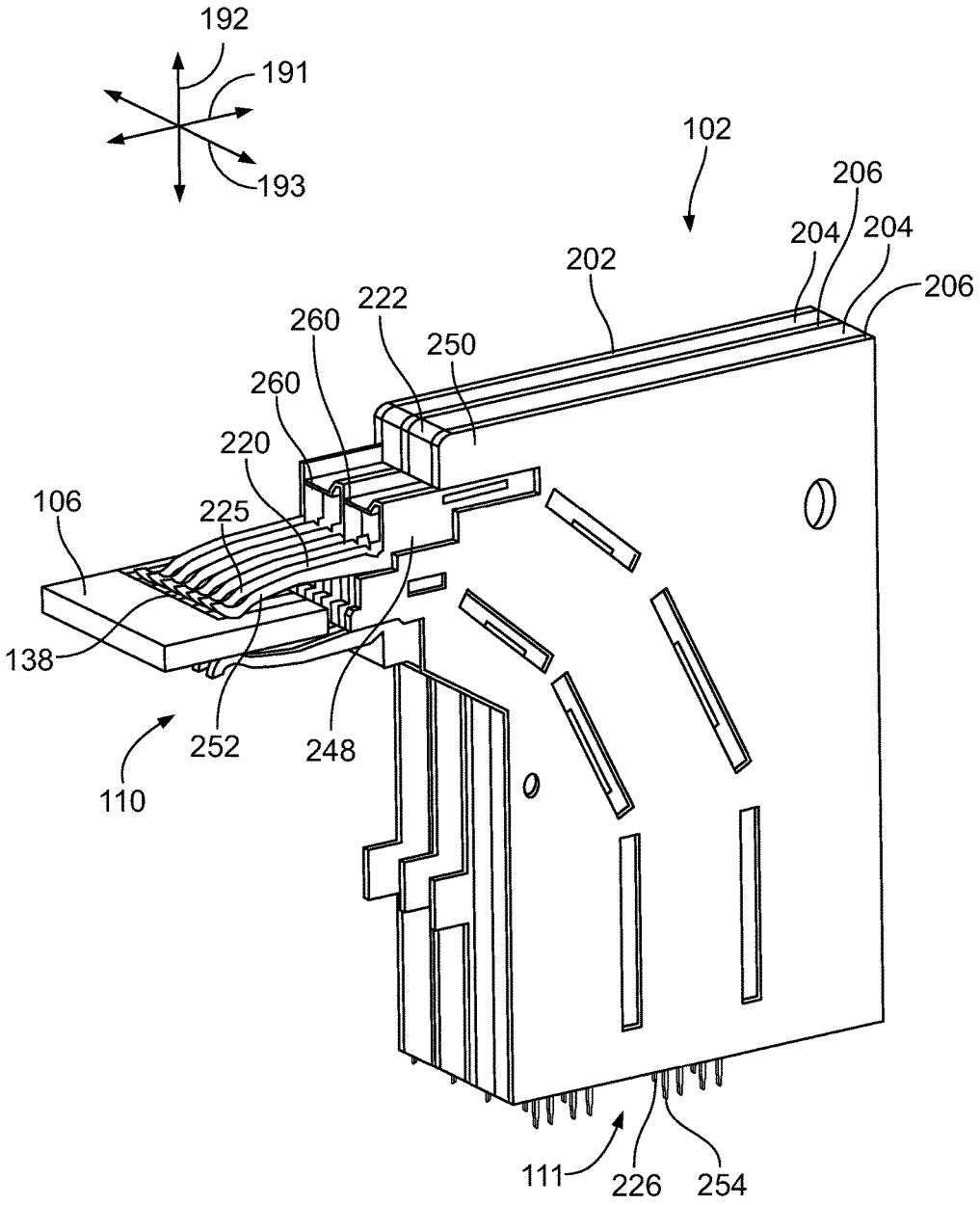
FIG. 3 is a perspective view of a module stack of the electrical connector and a circuit card according to an embodiment.

FIG. 3 is a perspective view of a module stack 202 of the electrical connector 102 and the circuit card 106 according to an embodiment. The housing 108 (FIG. 1) of the connector 102 is not shown in FIG. 3. The module stack 202 includes a plurality of contact modules 204 and ground shields 206 that are held within the housing 108. The module stack 202 of the electrical connector 102 is oriented with respect to a longitudinal or depth axis 191, a vertical axis 192, and a lateral axis 193. The axes 191-193 are mutually perpendicular. Although the vertical axis 192 appears to extend in a vertical direction parallel to gravity in FIG. 3, it is understood that the axes 191-193 are not required to have any particular orientation with respect to gravity.

The module stack 202 includes a plurality of the contact modules 204 and the ground shields 206 arranged side-by-side along the lateral axis 193. For example, the ground shields 206 may be interleaved between the contact modules 204 such that the ground shields 206 alternate with the contact modules 204 along the width of the stack 202. For example, two adjacent contact modules 204 may be separated from each other by one of the ground shields 206, and two adjacent ground shields 206 are separated from each other by one of the contact modules 204. The ground shields 206 may abut against the sides of the contact modules 204 in the stack 202.

The contact modules 204 define respective contact planes. The contact modules 204 in the stack 202 are oriented parallel to each other such that the contact planes extend parallel to each other (e.g., and parallel to the longitudinal axis 191). Each of the contact modules 204 may include multiple electrical signal conductors 220 and one or more dielectric bodies 222 that hold the signal conductors 220 in place. The dielectric bodies 222 prevent the signal conductors 220 from engaging each other and electrically shorting. Optionally, the dielectric bodies 222 may be overmolded on the signal conductors 220.

The signal conductors 220 include mating contacts 225 and mounting contacts 226. The mating contacts 225 protrude from the respective dielectric bodies 222 at the mating end 110 of the connector 102. The mating contacts 225 are configured to engage and electrically connect to corresponding conductors on the circuit card 106. In the illustrated embodiment, the mating contacts 225 are deflectable spring beams that removably engage corresponding contact pads 138 on the circuit card 106. In the illustrated embodiment, the mounting contacts 226 protrude from the respective dielectric bodies 222 at the mounting end 111 of the connector 102. The mounting contacts 226 are configured to engage and electrically connect to the circuit board 104 (shown in FIG. 1). In the illustrated embodiment, the mounting contacts 226 are compliant pin contacts, such as eye-of-the-needle pin contacts that thru-hole mount to the circuit board 104.

The ground shields 206 define ground planes that provide shielding between the signal conductors 220 in adjacent contact modules 204 on either side of the respective ground plane. The ground planes may be oriented parallel to the contact planes of the contact modules 204. The ground shields 206 include a plate 248 that is electrically conductive to provide electrical shielding between the contact modules 204. In one non-limiting embodiment, the plate 248 may be composed of one or more metals. In an alternative non-limiting embodiment, the plate 248 may be composed (or partially composed) of a conductive polymer, such as intrinsically conducting polymers or polymers that are dipped in or embedded with metallic particles. The plates 248 of the ground shields 206 are optionally at least partially covered by a cover material 250. The cover material 250 may be composed of one or more polymers, one or more metals, or a combination thereof (e.g., an electrically lossy material).

The ground shields 206 may include mating contacts 252 that align with the mating contacts 225 of the signal conductors 220. The mating contacts 252 of the ground shields 206 may be deflectable spring beams, similar to the mating contacts 225 of the signal conductors 220. The mating contacts 252 are configured to engage ground elements (not shown) of the circuit card 106 to establish a ground path between the circuit card 106 and the electrical connector 102. The ground shields 206 may also include mounting contacts 254 along the mounting end 111 of the connector 102. The mounting contacts 254 may be eye-of-the-needle pin contacts, like the mounting contacts 226 of the signal conductors 220, that are configured to be thru-hole mounted to ground elements of the circuit board 104 (FIG. 1). The mating contacts 252 and the mounting contacts 254 may be integral extensions of the respective plates 248.

In one or more embodiments, the ground shields 206 in the stack 202 are electrically connected to each other to electrically common the ground shields 206. The ground shields 206 include ground bridges 260 that extend across corresponding contact modules 204. The ground bridges 260 mechanically engage adjacent ground shields 206 on opposite sides of the corresponding contact modules 204. The ground bridges 260 are electrically conductive and provide conductive paths between the ground shields 206 on either side of the corresponding contact module 204 to electrically common the ground shields 206.

Figure 4:
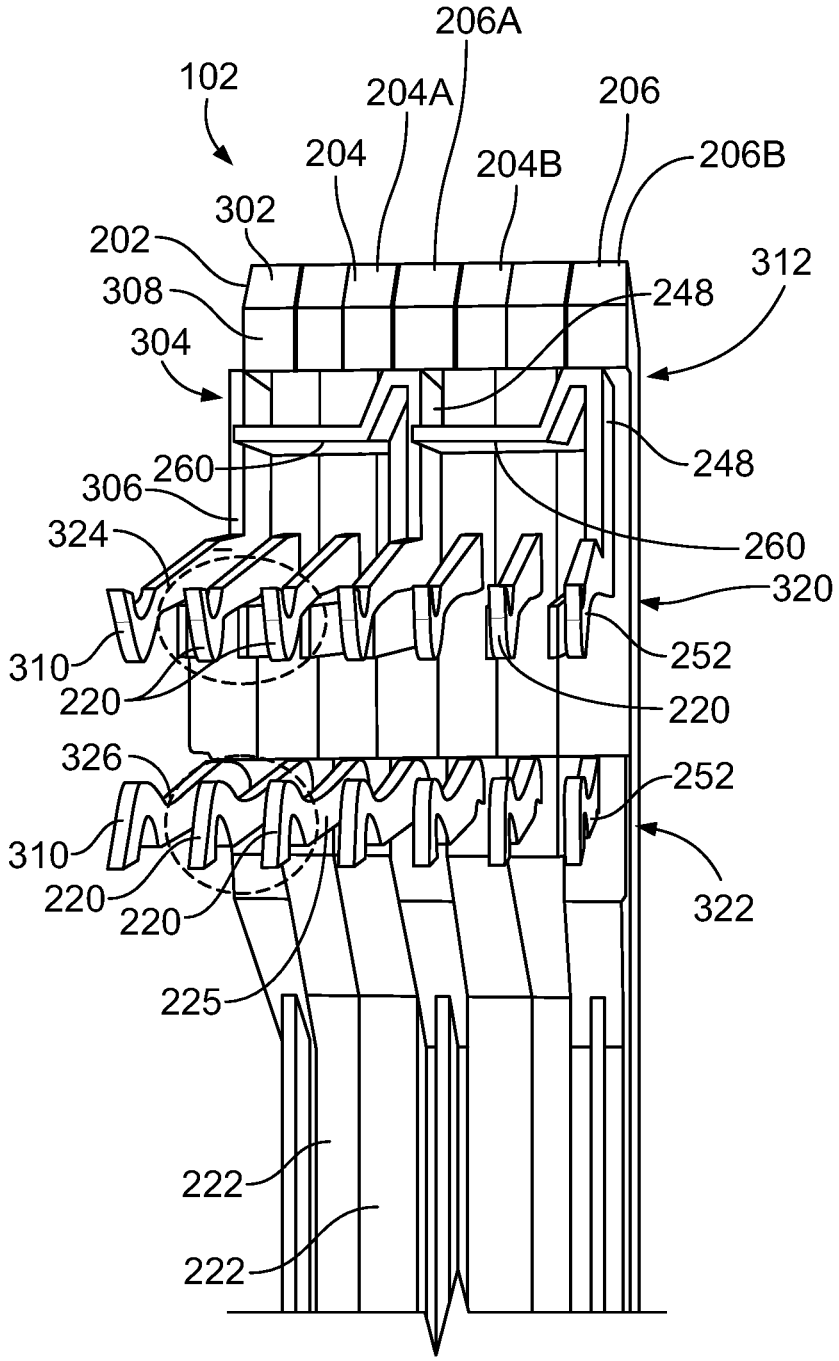
FIG. 4 is a front view of a portion of the module stack of the electrical connector according to an embodiment.

FIG. 4 is a front view of a portion of the module stack 202 of the electrical connector 102 according to an embodiment. In the illustrated embodiment, the module stack 202 includes two contact modules 204, two ground shields 206, and an end shield 302. The ground shields 206 each include one or more of the ground bridges 260. The end shield 302 is devoid of ground bridges. The end shield 302 is disposed at a first outer end 304 of the module stack 202. The end shield 302 in an embodiment may be similar to the ground shields 206 except for the lack of any ground bridges 260. For example, the end shield 302 may include a conductive plate 306 that is optionally at least partially covered by a cover material 308, and the end shield 302 defines mating contacts 310 that are similar to the mating contacts 252 of the ground shields 206. The end shield 302 according to an embodiment may be formed by removing ground bridges 260 from a completed ground shield 206 or by omitting a ground bridge formation or attachment step when making a ground shield 206. The end shield 302 is configured to be electrically connected to the ground shields 206 to electrically common the end shield 302 with the ground shields 206. As used herein, references to the ground shields 206 including ground bridges 260 may not refer to the end shield 302. Alternatively, the end shield 302 may be considered as one of the ground shields 206, albeit a ground shield 206 that lacks ground bridges 260.

The contact modules 204 in the illustrated embodiment each have four signal conductors 220. Each of the contact modules 204 optionally includes two dielectric bodies 222 disposed side-by-side, and each of the dielectric bodies 222 holds two of the four signal conductors 220 of the contact module 204. In an alternative embodiment, a single dielectric body 222 may hold all of the signal conductors 220 of the corresponding contact module 204. The mating contacts 225 of the signal conductors 220 in the module stack 202 are arranged in an upper row 320 and a lower row 322. The mating contacts 252, 310 of the ground shields 206 and the end shield 302 align with the mating contacts 225 in the upper and lower rows 320, 322. The mating contacts 225 of a first pair 324 of the four signal conductors 220 of each contact module 204 are aligned in the upper row 320, and the mating contacts 225 of a second pair 326 of the four signal conductors 220 are aligned in the lower row 322 below the first pair 324. Optionally, the signal conductors 220 in the first pair 324 and/or the signal conductors 220 in the second pair 326 may be utilized as differential signal pairs for transmitting differential signals. The mating contacts 252, 310 of the ground shields 206 and the end shield 302 align with the mating contacts 225 in the upper and lower rows 320, 322 and provide shielding along the sides of the pairs 324, 326 of the signal conductors 220.

The end shield 302 in the illustrated embodiment abuts a first contact module 204A of the two contact modules 204. The first contact module 204A is disposed between the end shield 302 and a first ground shield 206A of the ground shields 206. The first ground shield 206A is between the first contact module 204A and the second contact module 204B. The second contact module 204B is between the first ground shield 206A and the second ground shield 206B. The second ground shield 206B defines a second outer end 312 of the module stack 202. In the illustrated embodiment, the module stack 202 may be referred to as asymmetric because only one ground plane (e.g., the first ground shield 206A) separates the first and second contact modules 204A, 204B. The module stack 202 may be scaled in other embodiments to include more than the two contact modules 204A, 204B and the two ground shields 206A, 206B.

The front view in FIG. 4 shows one ground bridge 260 of each of the first and second ground shields 206A, 206B. The ground shields 206A, 206B may include more than one ground bridge 260, with the additional ground bridges 260 disposed rearward of the visible ground bridges 260 and concealed within the module stack 202. The ground bridges 260 are attached or fixed directly to the plates 248 of the respective ground shields 206. The ground bridges 260 extend laterally (from the respective plate 248) across corresponding contact modules 204 and engage the plate 248 of an adjacent ground shield 206 (or the plate 306 of the end shield 302) on an opposite side of the corresponding contact module 204. For example, in the illustrated embodiment, the ground bridge 260 of the first ground shield 206A extends laterally across the first contact module 204A and engages the plate 306 of the end shield 302. The end shield 302 and the first ground shield 206A are disposed on opposite sides of the first contact module 204A. Furthermore, the ground bridge 260 of the second ground shield 206B extends laterally across the second contact module 204B and engages the plate 248 of the first ground shield 206A. The first and second ground shields 206A, 206B are disposed on opposite sides of the second contact module 204B.

The ground bridges 260 are electrically conductive. For example, the ground bridges 260 may be composed of one or more metals or, alternatively, may be composed (or partially composed) of a conductive polymer, such as an intrinsically conducting polymer or a polymer dipped in or embedded with metallic particles. As such, the ground bridge 260 of the first ground shield 206A provides a conductive path that electrically connects the end shield 302 and the first ground shield 206A. The ground bridge 260 of the second ground shield 206B electrically connects the first and second ground shields 206A, 206B. Since the first ground shield 206A is electrically connected to both the end shield 302 and the second ground shield 206B, all three ground planes are electrically commoned, such that all three ground planes are at the same electrical potential (e.g., voltage). The ground bridges 260 may extend across the corresponding contact modules 204A, 204B through openings or recesses in the contact modules 204A, 204B. The ground bridges 260 within the openings or recesses avoid engaging the signal conductors 220 of the contact modules 204A, 204B.

In an embodiment, the first and second ground shields 206A, 206B are replicas or duplicates of each other. For example, the ground shields 206A, 206B have common sizes and shapes, common features, and are made via the same process. For example, the same component(s) that represent the first ground shield 206A in the module stack 202 may be used as the second ground shield 206B. In embodiments in which the module stack 202 includes three or more ground shields 206, the additional ground shields may also be replicas or duplicates of the first and second ground shields 206A, 206B. The use of duplicates for the ground shields 206 may reduce costs attributable to parts, tooling, and assembly relative to connectors that require at least two different ground shields with different polarities, for example. Optionally, the end shield 302 may be a duplicate of the ground shields 206A, 206B that has had the one or more ground bridges 260 removed.

In an embodiment, the ground shields 206 may be formed by stamping and forming a panel of sheet metal to define the plate 248, the mating contacts 252, and the mounting contacts 254 (shown in FIG. 3). The ground bridges 260 may also be stamped and formed from the panel of sheet metal concurrently with the plate 248. For example, the ground shields 206 may be monolithic such that each ground shield 206 has a unitary, one-piece construction that includes the plate 248 and the one or more ground bridges 260 extending from the plate 248. The ground bridges 260 may be formed by bending (and optionally folding) portions of the sheet metal out of the plane of the plate 248 to extend laterally from the plate 248. The cover material 250 of the ground shields 206 may be subsequently applied onto the sheet metal via overmolding, dipping, painting, physical vapor deposition, or the like. It is understood that referring to the ground shields 206 as monolithic refers to the plate 248 having a one-piece, unitary construction with the one or more ground bridges 260 (and optionally the mating contacts 252 and/or the mounting contacts 254), but does not refer to the cover material 250, which is a separate and discrete component.

Figure 5:
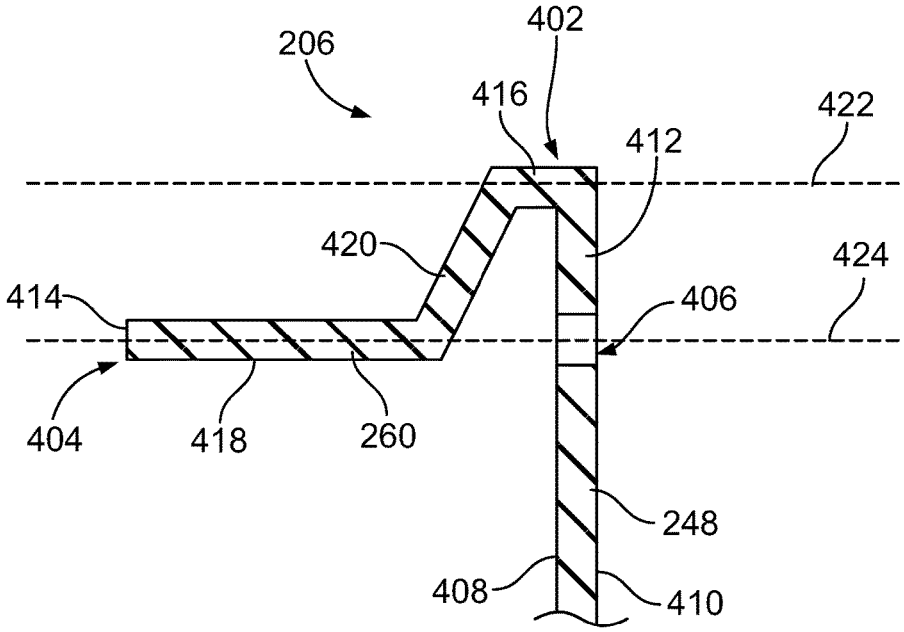
FIG. 5 is a front cross-sectional view of a top portion of one ground shield of the electrical connector according to an embodiment.

FIG. 5 is a front cross-sectional view of a top portion of one of the ground shields 206 of the electrical connector 102 (FIG. 4) according to an embodiment. The illustrated portion of the ground shield 206 includes the plate 248 and the ground bridge 260. The cover material 250 of the ground shield 206 is not shown.

The plate 248 may include a first planar side 408 and a second planar side 410 that is opposite the first planar side 408. In an embodiment, the ground bridge 260 extends laterally from (or beyond) the first planar side 408. The ground bridge 260 is cantilevered from the plate 248. For example, the ground bridge 260 includes a fixed end 402 and a free end 404. The fixed end 402 is connected to the plate 248. The ground bridge 260 extends from the fixed end 402 to the free end 404, which is spaced apart from the plate 248. In an embodiment in which the ground bridge 260 is unitary with the plate 248, the interface between the fixed end 402 and the plate 248 may be seamless. A distal tip 414 of the ground bridge 260 at the free end 404 is configured to engage the plate 248 of an adjacent ground shield 206 (or the plate 306 of the end shield 302 shown in FIG. 3).

The ground shield 206 includes a bridge slot 406 that extends through the plate 248. The bridge slot 406 may extend fully through the plate 248, penetrating both the first and second planar sides 408, 410. In an alternative embodiment, the bridge slot 406 may extend from the second planar side 410 towards the first planar side 408 without penetrating the first planar side 408. The ground bridge 260 extends from the plate 248 at a location that is spaced apart from the bridge slot 406. The fixed end 402 of the ground bridge 260 in the illustrated orientation is disposed above the bridge slot 406 and is spaced apart from the bridge slot 406 by an intervening section 412 or length of the plate 248.

In the illustrated embodiment, the ground bridge 260 includes multiple segments between the fixed end 402 and the free end 404. For example, the ground bridge 260 may include a shoulder 416 that is attached or connected to the plate 248 at the fixed end 402, a shelf 418 that extends to the distal tip 414, and a jogged section 420 between the shoulder 416 and the shelf 418. The distal tip 414 may be an end portion of the shelf 418, or may extend from the shelf 418. The jogged section 420 is angled and/or curved relative to the shoulder 416 and the shelf 418 such that the shelf 418 is disposed in a different plane than the shoulder 416. For example, the shoulder 416 is oriented along a first plane 422 and the shelf 418 is oriented along a different, second plane 424 that is spaced apart from the first plane 422. In the illustrated embodiment, the jogged section 420 is linear and extends transverse to both the shoulder 416 and the shelf 418 (e.g., transverse to both planes 422, 424). Due to the angled jogged section 420, the ground bridge 260 may resemble a "Z" shape. In an alternative embodiment, the jogged section 420 may be curved, and the ground bridge 260 optionally may resemble an "S" shape.

In an embodiment, the shelf 418 is coplanar with the bridge slot 406. For example, the plane 424 of the shelf 418 aligns with the bridge slot 406, although the shelf 418 is physically spaced apart from the bridge slot 406. Since the shelf 418 aligns with the bridge slot 406, the distal tip 414 of the ground bridge 260 at the end of the shelf 418 is configured to be received into the bridge slot 406 of an adjacent ground shield 206 across a corresponding contact module 204 (shown in FIG. 4). In an embodiment, the ground shields 206 may be hermaphroditic because the ground shields 206 include both a ground bridge 260 and a bridge slot 406. It is noted that the shoulder 416 of the ground bridge 260 is not coplanar with the bridge slot 406.

In the illustrated embodiment, the shoulder 416 is oriented parallel to the shelf 418, such that the first plane 422 is parallel to the second plane 424. Furthermore, the shoulder 416 and the shelf 418 may be generally perpendicular (e.g., oriented within five degrees of a right angle) to a plane of the plate 248. In other embodiments, the shoulder 416 and the shelf 418 may have other orientations relative to each other and/or relative to the plate 248.

Figure 6:
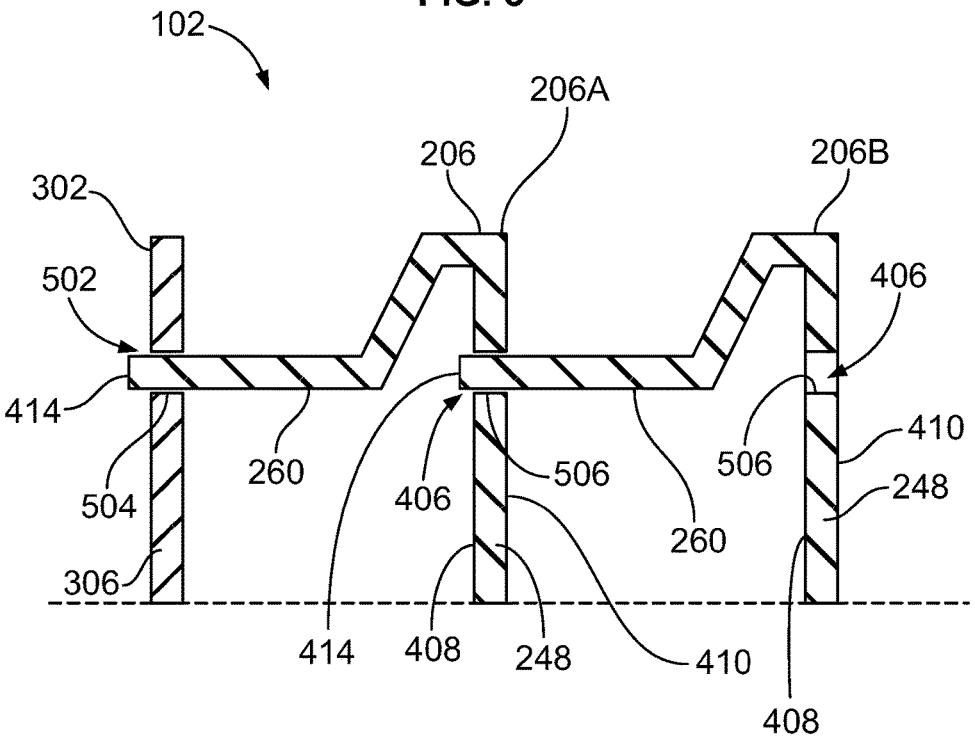
FIG. 6 is a front cross-sectional view of a top portion of the electrical connector showing only an end shield and two ground shields according to an embodiment.

FIG. 6 is a front cross-sectional view of a top portion of the electrical connector 102 showing only the end shield 302 and the ground shields 206 according to an embodiment. The cover materials 250, 308 of the ground shields 206 and the end shield 302, respectively, are not shown in FIG. 6. The plate 306 of the end shield 302 defines a bridge slot 502 that extends through the plate 306. The bridge slot 502 of the end shield 302 may be similar in size, shape, and location (relative to the plate 306) to the bridge slots 406 of the ground shields 206.

In the illustrated embodiment, when the electrical connector 102 is assembled, the distal tips 414 of the ground bridges 260 of the ground shields 206 are received within the bridge slots 406, 502 to electrically connect the ground shields 206 and the end shield 302. For example, the distal tip 414 of the ground bridge 260 of the first ground shield 206A is received into the bridge slot 502 of the end shield 302. The distal tip 414 engages edges 504 of the bridge slot 502 which electrically connects the ground shield 206A and the end shield 302. The edges 504 of the bridge slot 502 are edges of the plate 306 that define the bridge slot 502. Likewise, the distal tip 414 of the ground bridge 260 of the second ground shield 206B is received into the bridge slot 406 of the first ground shield 206A. The distal tip 414 engages edges 506 of the bridge slot 406 which electrically connects the first and second ground shields 206A, 206B. Optionally, the distal tips 414 may protrude through the respective bridge slots 502, 406 such that a portion of each distal tip 414 extends beyond the corresponding plate 306, 248.

The second ground shield 206B also includes a bridge slot 406 that is configured to receive the distal tip 414 of a ground bridge 260 of another replica ground shield 206 (not shown) therein, such as if the electrical connector 102 includes more than two contact modules 204 (FIG. 4). The ground shields 206A, 206B in the illustrated embodiment are hermaphroditic replicas (or duplicates) because each of the ground shields 206A, 206B includes a bridge slot 406 and a ground bridge 260. The ground bridge 260 is configured to extend across a contact module 204 into the bridge slot 406 of an adjacent ground shield 206 on one side of the respective ground shield 206, and the bridge slot 406 is configured to receive the ground bridge 260 of an adjacent ground shield 206 disposed on another side of the respective ground shield 206.

In the illustrated embodiment, the ground bridges 260 of the ground shields 206A, 206B extend laterally from the first planar side 408 of the respective plate 248. For example, the ground bridge 260 of the first ground shield 206A extends laterally across the first contact module 204A (FIG. 4) to the end shield 302, and the ground bridge 260 of the second ground shield 206B extends laterally across the second contact module 204B (FIG. 4) to the first ground shield 206A. The second planar sides 410 of the plates 248 do not have any respective ground bridges or other extensions extending therefrom. The bridge slots 406 of the ground shields 206 receive the distal tips 414 of the ground bridges 260 of the adjacent ground shields 206 through the second planar side 410. Therefore, the ground shields 206 link up in a daisy chain that extends from the end shield 302. The side from which the ground bridges 260 extend does not matter, as the ground bridges 260 in an alternative embodiment may extend only from the second planar sides 410 of the plates 248, and the bridge slots 406 may receive the adjacent ground bridges 260 through the first planar side 408.

Figure 7:
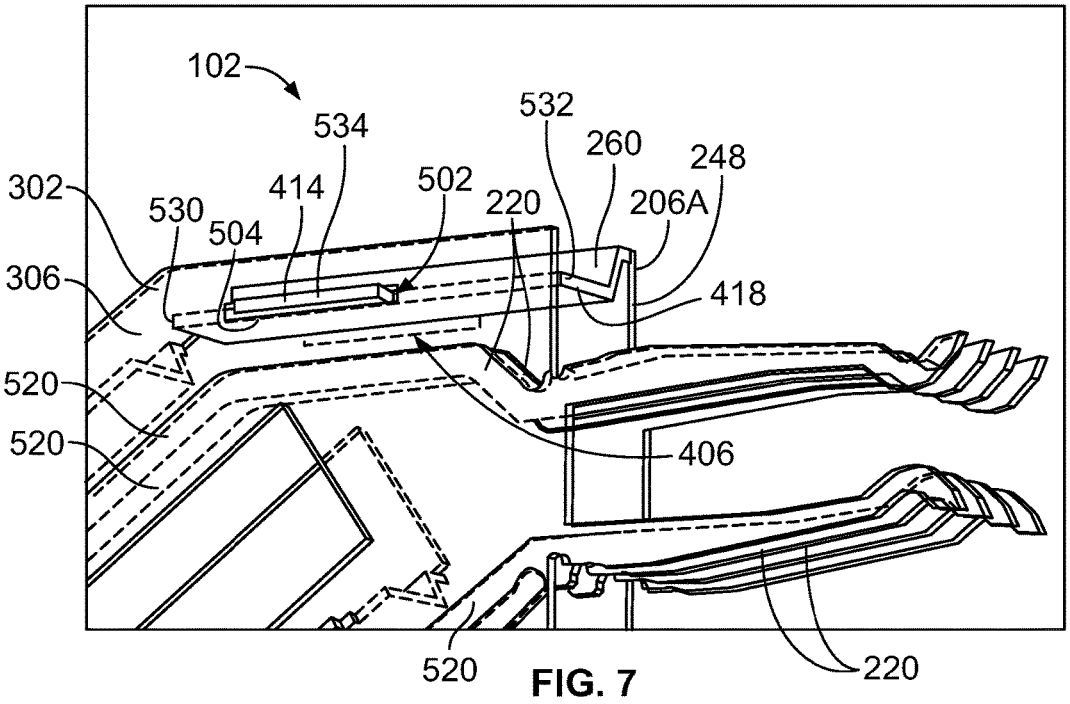
FIG. 7 is a perspective view of a top portion of the electrical connector showing only the end shield, a first ground shield, and signal conductors of a first contact module according to an embodiment.

FIG. 7 is a perspective view of a top portion of the electrical connector 102 showing only the end shield 302, the first ground shield 206A, and the signal conductors 220 of the first contact module 204A (shown in FIG. 4) according to an embodiment. In FIG. 7, the components that are concealed by the end shield 302 are illustrated in phantom. The signal conductors 220 have intermediate segments 520 that extend from the mating contacts 225 to the mounting contacts 226 (shown in FIG. 3). The intermediate segments 520 are disposed laterally between the plate 306 of the end shield 302 and the plate 248 of the ground shield 206A.

In an embodiment, the shelf 418 of the ground bridge 260 of the ground shield 206A has a width extending between a first edge 530 of the shelf 418 and a second edge 532 of the shelf 418, which is opposite the first edge 530. The bridge slot 502 of the end shield 302 is narrower than the width of the shelf 418, such that the bridge slot 502 is too narrow to receive the shelf 418 therein. The ground bridge 260 includes a tab 534 extending from the shelf 418 at the distal tip 414 of the ground bridge 260. The tab 534 is narrower than the shelf 418 and is sized to fit within the bridge slot 502. The tab 534 engages the edges 504 of the bridge slot 502 to electrically connect the ground shield 206A and the end shield 302. The bridge slot 502 may be sized to accommodate the tab 534 via a compliant or interference fit. Optionally, the shelf 418 may abut against the plate 306 of the end shield 302 when the tab 534 is received within the bridge slot 502.

The bridge slot 406 (shown in phantom) of the first ground shield 206A may be sized, shaped, and positioned on the plate 248 in the same way as the bridge slot 502 of the end shield 302, such that the bridge slot 406 is configured to receive a tab of the ground bridge 260 of the second ground shield 206B (FIG. 6) therein.

Figure 8:
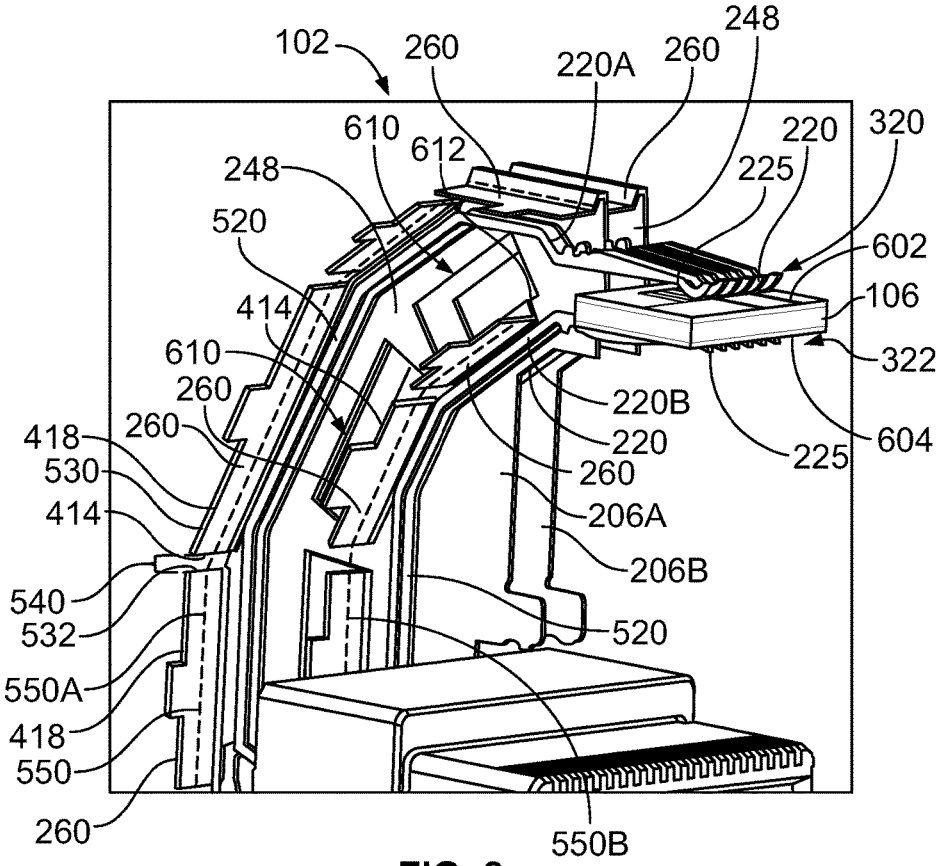
FIG. 8 is a perspective view of the electrical connector showing only first and second ground shields and the signal conductors of first and second contact modules according to an embodiment.

FIG. 8 is a perspective view of the electrical connector 102 showing only the first and second ground shields 206A, 206B and the signal conductors 220 of the first and second contact modules 204A, 204B (shown in FIG. 4) according to an embodiment. In the illustrated embodiment, each of the ground shields 206A, 206B includes a plurality of the ground bridges 260. Each of the ground bridges 260 may be the same or similar to the ground bridge 260 shown in FIG. 5. The multiple ground bridges 260 extend in a common direction from the respective plate 248. The multiple ground bridges 260 are arranged in at least one shielding line 550. Each shielding line 550 is curved or angled to correspond with a path of the intermediate segments 520 of the signal conductors 220. In addition, although not visible in the illustrated view, the ground shields 206A, 206B may include a plurality of the bridge slots 406 defined through the respective plates 248. For example, the distal tips 414 (shown in FIG. 6) of the ground bridges 260 of the second ground shield 206B are configured to be received into corresponding bridge slots 406 of the first ground shield 206A, which electrically connects the first and second ground shields 206A, 206B at multiple contact locations along the shielding line 550. Similarly, the distal tips 414 of the ground bridges 260 of the first ground shield 206A may be received into multiple bridge slots 502 (FIG. 7) of the end shield 302 (FIG. 7) to electrically connect the first ground shield 206A to the end shield 302 at multiple contact locations.

The ground bridges 260 within a common shielding line 550 may be positioned end-to-end with a designated spacing distance 540 between adjacent ground bridges 260. The designated spacing distance 540 may be defined between the first edge 530 of the shelf 418 of one ground bridge 260 and the second edge 532 of the shelf 418 of the adjacent ground bridge 260 in the shielding line 550. In an embodiment, the designated spacing distance 540 between adjacent ground bridges 260 in a shielding line 550 may be no greater than 3 mm to provide a designated level of shielding along the length of the signal conductors 220.

In the illustrated embodiment, the ground bridges 260 of each of the ground shields 206A, 206B are arranged in two shielding lines 550, referred to herein as an outer shielding line 550A and an inner shielding line 550B. For example, the signal conductors 220 are arranged to define upper conductors 220A and lower conductors 220B. The mating contacts 225 of the upper conductors 220A are disposed within the upper row 320 that engages a top side 602 of the circuit card 106. The mating contacts 225 of the lower conductors 220B are disposed within the lower row 322 that engages a bottom side 604 of the circuit card 106. The ground bridges 260 in the outer shielding line 550A extend along an outer perimeter of the intermediate segments 520 of the upper conductors 220A. The ground bridges 260 in the inner shielding line 550B are disposed between the upper conductors 220A and the lower conductors 220B within the same contact module 204 (FIG. 4) and provide shielding to reduce cross-talk between the upper and lower conductors 220A, 220B. For example, the ground bridges 260 in the inner shielding line 550B may extend along an outer perimeter of the intermediate segments 520 of the lower conductors 220B.

In an embodiment, the ground shields 206A, 206B are monolithic and the multiple ground bridges 260 are unitary with the respective plates 248 from which the ground bridges 260 are fixed. The ground bridges 260 may be formed by stamping and forming (e.g., bending and/or folding) the ground bridges 260 out of the plane of the respective plate 248. In an embodiment, the ground bridges 260 within the inner shielding line 550B are bent out of the plates 248 to define windows 610 in the plates 248. The windows 610 indicate the amount of material of the plates 248 that was used to define the ground bridges 260 for the inner shielding line 550B. The ground bridges 260 of the inner shielding line 550B extend from inner edges 612 of the windows 610. It is recognized that the windows 610 are separate and discrete from the bridge slots 406 (shown in FIG. 7). The windows 610 are spaced apart from the bridge slots 406. For example, although not visible in FIG. 8, the ground bridges 260 of the second ground shield 206B within the inner shielding line 550B are received into bridge slots 406 of the first ground shield 206A, not within the windows 610 of the first ground shield 206A.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely example embodiments. Many other embodiments and modifications within the spirit and scope of the claims will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. An electrical connector comprising:

a plurality of contact modules disposed side by side within a housing, each of the contact modules including multiple electrical signal conductors held by a dielectric body of the respective contact module; and a plurality of ground shields interleaved with the contact modules within the housing such that the ground shields alternate with the contact modules, each of the ground shields including a plate that defines a bridge slot therethrough and a ground bridge extending from the plate, the ground bridge extending from the plate at a location that is spaced apart from the bridge slot, wherein the ground bridges of the ground shields extend laterally across corresponding contact modules, wherein distal tips of the ground bridges are received within the bridge slots of adjacent ground shields disposed along opposite sides of the corresponding contact modules, and engage edges of the bridge slots to electrically connect the ground shields together.

2. The electrical connector of claim 1, wherein the ground shields are replicas of each other such that the plates, bridge slots, and ground bridges of the ground shields have common sizes and shapes.

3. The electrical connector of claim 1, wherein the distal tip of the ground bridge of one of the ground shields extends into a bridge slot defined within a plate of an end shield to electrically connect the one ground shield to the end shield, the end shield being devoid of a ground bridge.

4. The electrical connector of claim 1, wherein each of the ground shields is monolithic such that the ground bridge is unitary with the plate from which the ground bridge extends.

5. The electrical connector of claim 1, wherein the ground bridges of the ground shields include a shelf that extends to the distal tip of the respective ground bridge, a shoulder that is attached to the plate, and a jogged section between the shelf and the shoulder, the jogged section being angled or curved such that the shelf is disposed in a different plane than the shoulder.

6. The electrical connector of claim 5, wherein the shelf of the ground bridge is coplanar with the bridge slot of the respective plate from which the ground bridge extends.

7. The electrical connector of claim 5, wherein the shelf of the ground bridge is parallel to the shoulder of the ground bridge, and both the shelf and the shoulder are perpendicular to a plane of the respective plate from which the ground bridge extends.

8. The electrical connector of claim 1, wherein the ground bridges of the ground shields include a shelf having a width that extends between a first edge and a second edge, and the distal tip of the ground bridge includes a tab that projects from the shelf and is narrower than the width of the shelf, wherein the bridge slots of the ground shields are narrower than the widths of the shelves and are sized to accommodate the tabs of the ground bridges therein.

9. The electrical connector of claim 1, wherein each of the ground shields includes a plurality of the ground bridges extending in a common direction from the respective plate, the multiple ground bridges arranged in a shielding line that corresponds to a path of the signal conductors within the dielectric bodies of the contact modules, wherein the distal tips of the ground bridges of a first ground shield of the ground shields are received into corresponding bridge slots defined through the plate of a second ground shield of the ground shields to electrically connect the first and second ground shields at multiple locations along the shielding line.

10. The electrical connector of claim 1, wherein the signal conductors of the contact modules include upper conductors and lower conductors, wherein each of the ground shields includes a plurality of the ground bridges extending in a common direction from the respective plate and arranged in a shielding line, wherein the ground bridges in the shielding line of a first ground shield of the ground shields extend through the corresponding contact module at locations disposed between the upper conductors and the lower conductors of the corresponding contact module.

11. The electrical connector of claim 1, wherein each of the plates of the ground shields includes a first planar side and an opposite, second planar side, the first planar side of a corresponding one of the ground shields facing a first contact module and the second planar side of the corresponding ground shield facing a second contact module, wherein the ground bridge of the corresponding ground shield extends laterally from the first planar side of the plate across the first contact module and the bridge slot of the corresponding ground shield receives the distal tip of the ground bridge of the adjacent ground shield through the second planar side, the ground bridge of the adjacent ground shield extending across the second contact module.

12. An electrical connector comprising:

a plurality of contact modules disposed side by side within a housing, each of the contact modules including multiple electrical signal conductors held by a dielectric body of the respective contact module; and a plurality of ground shields interleaved with the contact modules within the housing such that the ground shields alternate with the contact modules, each of the ground shields including a plate and a ground bridge extending from the plate, the ground bridge including a shoulder attached to the respective plate at a fixed end of the ground bridge, a shelf that extends to a distal tip of the ground bridge, and a jogged section between the shelf and the shoulder, the jogged section being angled or curved such that the shelf is disposed in a different plane than the shoulder, each of the ground shields defines a bridge slot therethrough that is spaced apart from the fixed end of the ground bridge along the respective plate, wherein the ground bridges of the ground shields extend laterally across corresponding contact modules and the distal tips engage adjacent ground shields disposed along opposite sides of the corresponding contact modules to electrically connect the ground shields together.

13. The electrical connector of claim 12, wherein the jogged section of the ground bridge is linear and extends transverse to the shelf and the shoulder of the ground bridge.

14. The electrical connector of claim 12, wherein each of the ground shields is monolithic such that the ground bridge is unitary with the plate from which the ground bridge extends.

15. The electrical connector of claim 12, wherein the bridge slot is configured to receive the distal tip of the ground bridge of another one of the ground shields therein.

16. The electrical connector of claim 15, wherein the shelf of the ground bridge of each of the ground shields is coplanar with the bridge slot of the respective plate from which the ground bridge extends, and the shoulder of the ground bridge is not coplanar with the bridge slot of the respective plate.

17. The electrical connector of claim 15, wherein the ground bridges of the ground shields include a shelf having a width that extends between a first edge and a second edge, and the distal tip of the ground bridge includes a tab that projects from the shelf and is narrower than the width of the shelf, wherein the bridge slots of the ground shields are narrower than the widths of the shelves and are sized to accommodate the tabs of the ground bridges therein.

18. An electrical connector comprising:

a plurality of contact modules disposed side by side within a housing, each of the contact modules including multiple electrical signal conductors held by a dielectric body of the respective contact module; and a plurality of ground shields interleaved with the contact modules within the housing such that the ground shields alternate with the contact modules, each of the ground shields including a plate that defines a bridge slot therethrough and a ground bridge extending from the plate, the ground bridge extending from the plate at a location that is spaced apart from the bridge slot, wherein the ground shields are monolithic such that the ground bridges are unitary with the respective plates from which the ground bridges extend, and wherein the ground bridges of the ground shields extend laterally across corresponding contact modules, wherein distal tips of the ground bridges are received within the bridge slots of adjacent ground shields disposed along opposite sides of the corresponding contact modules, and engage edges of the bridge slots to electrically connect the ground shields together.

19. The electrical connector of claim 18, wherein the ground shields are replicas of each other such that the plates, bridge slots, and ground bridges of the ground shields have common sizes and shapes.

20. The electrical connector of claim 18, wherein the ground bridge of each of the ground shields includes a shelf that extends to the distal tip of the respective ground bridge, a shoulder that is attached to the respective plate, and a jogged section between the shelf and the shoulder, the jogged section being angled or curved such that the shelf is disposed in a different plane than the shoulder and the shelf is coplanar with the bridge slot of the respective plate.

* * * * *